US005676539A

United States Patent [19]

Draper

[11] Patent Number: 5,676,539

[45] Date of Patent: Oct. 14, 1997

[54] GAS BURNER MOUNTING

[75] Inventor: Dennis I. Draper, Walnut, Ill.

[73] Assignee: Harper-Wyman Company, Aurora, Ill.

[21] Appl. No.: 635,689

[22] Filed: Apr. 22, 1996

[51] Int. Cl.[6] ..... F23D 14/62

[52] U.S. Cl. ..... 431/354; 126/39 R; 239/600

[58] Field of Search ..... 126/39 R, 41 R, 126/39 E, 39 H, 39 N, 51; 431/354, 154, 355, 343; 239/600, 390

[56] References Cited

U.S. PATENT DOCUMENTS

| | | | |
|---|---|---|---|
| 4,627,411 | 12/1986 | Mertler | 126/39 R |
| 4,773,384 | 9/1988 | Koziol | 126/41 R |
| 4,989,579 | 2/1991 | Murphy et al. | 126/41 R |
| 5,052,920 | 10/1991 | Warren | 239/600 |
| 5,152,276 | 10/1992 | Brock et al. | 126/39 R |
| 5,249,958 | 10/1993 | Freber | 126/41 R |

*Primary Examiner*—James C. Yeung
*Attorney, Agent, or Firm*—Mason, Kolehmainen, Rathburn & Wyss

[57] ABSTRACT

A gas burner is interconnected with structure such as a range top wall or mixing tube flange by interengagement of a mounting projection and a locking hole. The locking hole has an entry portion and a narrower capture portion. The mounting projection has a neck portion and an enlarged head portion. The enlarged head portion is inserted through the entry portion of the locking hole and the neck portion is then shifted into the capture portion to accomplish a locking function. In one arrangement the gas burner is of mild cold rolled steel and the mounting projection is formed integral and of one single piece with the burner wall. In another arrangement, the burner is formed of galvanized or stainless steel, and the locking projection is formed integral and of one single piece with the cooperating mounting element. In another arrangement, the burner is supported by a bracket having mounting projections.

16 Claims, 3 Drawing Sheets

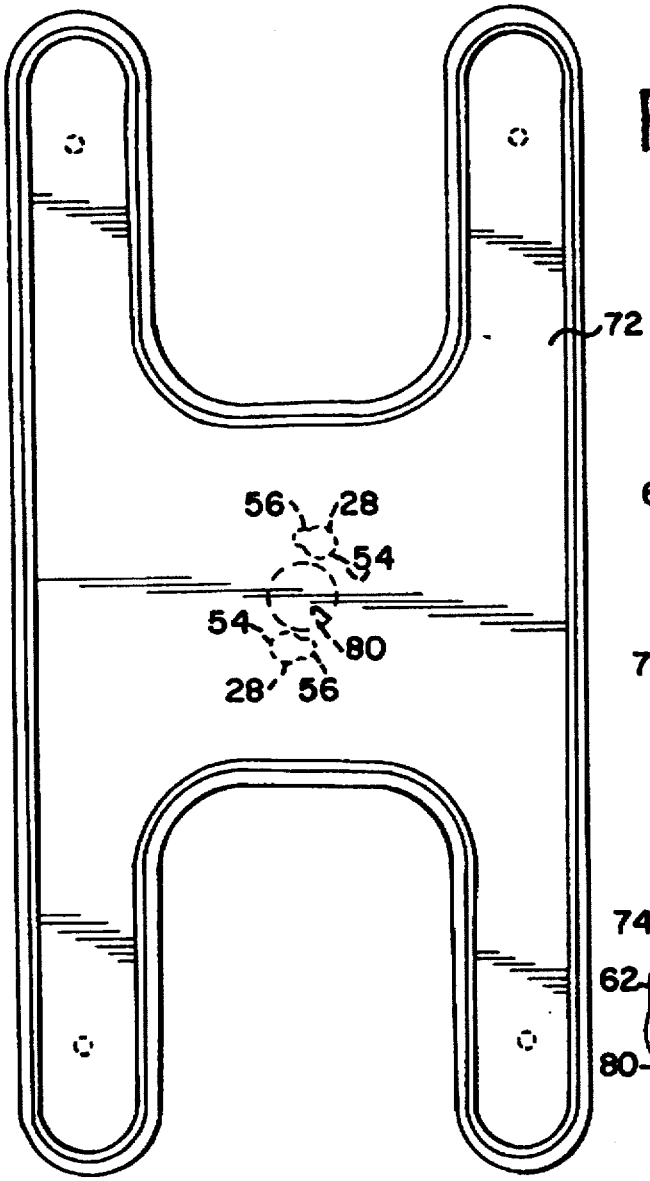
FIG. 5
FIG. 6
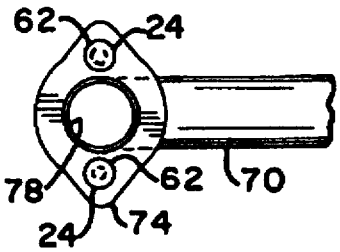
FIG. 8
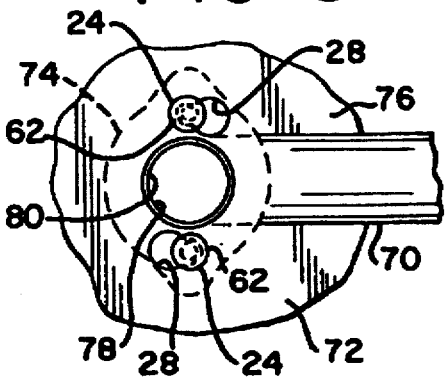
FIG. 7
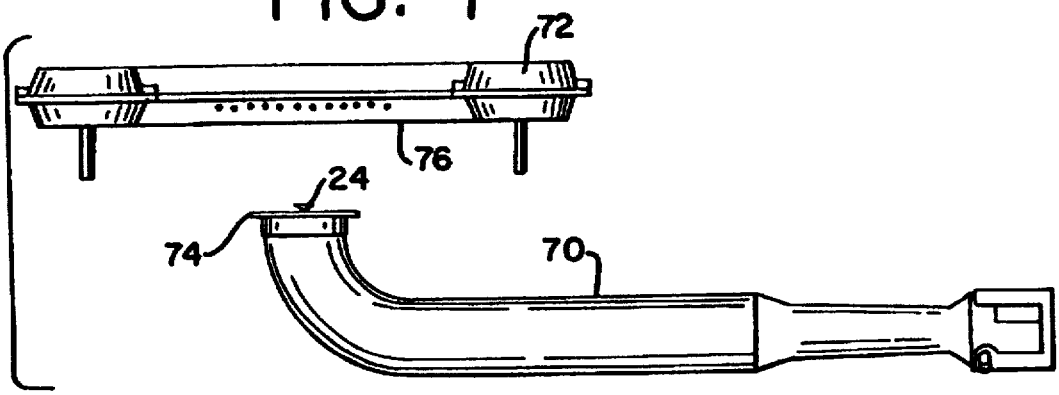

GAS BURNER MOUNTING

FIELD OF THE INVENTION

The present invention relates to an improved domestic gas cooking burner mounting apparatus and method.

DESCRIPTION OF THE PRIOR ART

Domestic gas cooking burners are used in appliances such as ranges, cook tops and barbeque grills. The gas burner is typically a hollow body that receives a mixture of gas and primary air from a mixing tube and includes burner ports where the mixture exits and burns in the presence of secondary air to perform a heating and cooking function. Depending on the application, a burner may be a formed body of material such as cold rolled steel, galvanized steel or stainless steel.

The gas burner is secured in position within the appliance. In a typical range or cook top installation, the burner base is attached to the range top wall with fasteners. One known fastening approach is to weld threaded studs to the underside of the burner base. The studs extend through holes in the range top wall and are secured by nuts that are threaded in place beneath the range top wall. This and similar approaches using various types of fasteners are subject to disadvantages because numerous discrete parts and inconvenient assembly steps are required.

In other gas cooking burner installations, mounting brackets may be used to mount the burner. For example, a range top burner may be supported by a bracket that is attached to a range top at a location offset from the burner position. Similarly, a galvanized or stainless steel barbeque burner may be secured to a flange or bracket of softer cold rolled steel. Fasteners such as studs or screws and nuts have typically been used in such installations. The need for separate fasteners is a disadvantage.

Various approaches have also been used to attach inlet manifolds to gas burners. In some cases, such as a stainless steel or galvanized barbeque burner, it is necessary to attach a manifold of a dissimilar material such a formed manifold of a mild steel. As with the typical burner mounting systems, the use of discrete fasteners and assembly steps has been a disadvantage.

SUMMARY OF THE INVENTION

A principal object of the present invention is to provide an improved apparatus and an improved method for mounting domestic gas cooking burners. Other objects are to provide an apparatus and method that avoids the need for additional parts such as fasteners and additional assembly steps; to provide an apparatus and method that is well suited for mounting or connecting gas burner parts of dissimilar materials; to provide a mounting apparatus and method that avoids the possibility of leakage from the gas burner; and to provide an apparatus and method that overcomes disadvantages of known gas burner mounting systems.

In brief, in accordance with the present invention, there is provided a gas burner mounting apparatus for establishing a mounting interconnection between a domestic gas cooking burner and another element. The mounting apparatus includes a first wall defined by one of the burner and the element, and a second wall defined by the other of the burner and the element. The first wall is formed of cold rolled steel. The first and second walls face one another and are adjacent to one another. At least one mounting projection extends from the first wall toward and through the second wall. The projection is integral and of one single piece with the first wall and includes an enlarged locking head and a reduced neck between the first wall and the locking head. The second wall includes a locking hole receiving each mounting projection. The locking hole includes an entry portion larger than the locking head for passage of the locking head through the second wall and a capture portion extending laterally from the entry portion. The capture portion is smaller than the locking head and large enough to receive the reduced neck.

BRIEF DESCRIPTION OF THE DRAWING

The present invention together with the above and other objects and advantages may best be understood from the following detailed description of the preferred embodiments of the invention illustrated in the drawings, wherein:

FIG. 5 is a top plan view of a barbeque grill gas burner;

FIG. 6 is a fragmentary top view of a mixing tube to be mounted to the gas burner of FIG. 5;

FIG. 7 is an exploded view showing the gas burner of FIG. 5 and the mixing tube of FIG. 6 prior to assembly;

FIG. 8 is a fragmentary top view of the bottom wall of the gas burner of FIG. 5 after assembly to the mixing tube of FIG. 6;

DETAILED DESCRIPTION OF THE PREFERRED EMBODIMENTS

Figure 1:
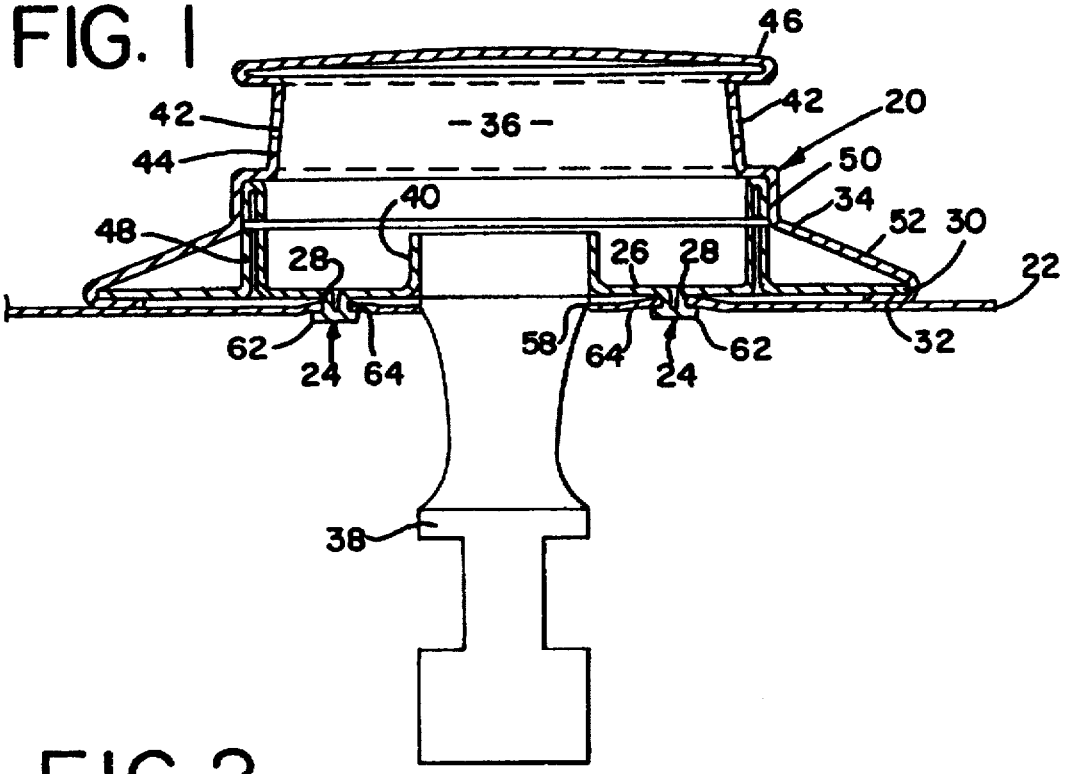
FIG. 1 is a vertical sectional view of an assembly of a domestic gas range top cooking burner and range top wall in accordance with the present invention.

Having reference now to the drawings, in FIG. 1 there is shown an assembly of a domestic range top gas burner 20 mounted to the top surface of a range top wall 22 in accordance with the principles of the present invention. Mounting projections 24 formed on a base wall 26 of the gas burner 20 are received in locking holes 28 of the range top wall 22 in order to secure the gas burner 20 in position.

The gas burner 20 includes the burner base wall 26 having an outer periphery 30 captured by a formed flange 32 of a burner cap member 34. A chamber 36 defined between the base wall 26 and the cap member 34 is supplied with a mixture of gas and primary air from a venturi mixing tube 38 having its outlet end press fitted into a collar 40 at the center of the base wall 26. The mixture exits from the chamber 36 through burner ports 42 formed in a port wall 44 below a cap portion 46. The mixture is ignited and burns with secondary air to provide heat for cooking.

An upstanding flange 48 of the base wall 26 cooperates with a collar portion 50 of the burner cap 34 to isolate a skirt portion 52 from the chamber 36. The skirt 52 provides a stable and easily cleaned burner base. The gas burner 20 rests solidly upon the large diameter, continuous, circular formed flange 32.

Figure 3:
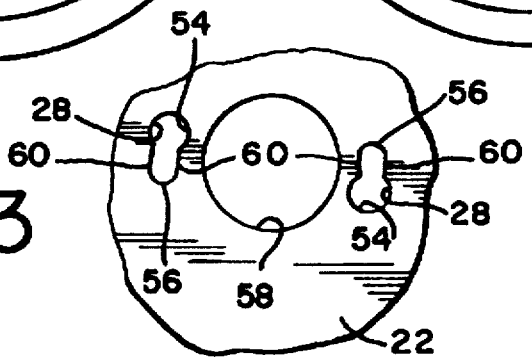
FIG. 3 is a fragmentary bottom view of the range top wall of the assembly of FIG. 1.

A pair of the locking holes 28 (FIG. 3) are provided in the range top wall 22. Each locking hole 28 includes an enlarged entry portion 54 of generally circular shape. Extending laterally from the enlarged entry portion 54 is a capture portion 56 having a width smaller than the diameter of the entry portion 54. The locking holes are symmetrical about a mixture tube receiving hole 58 provided in the range top wall 22. The capture portions 56 are of generally uniform width, and have generally parallel side walls 60. The capture portions 56 extend in opposite cartesian directions. The term cartesian direction is used to specify a direction in a system of cartesian coordinates. The capture portions 56 extend in the same rotational direction relative to the center of the tube receiving hole 58.

Figure 2:
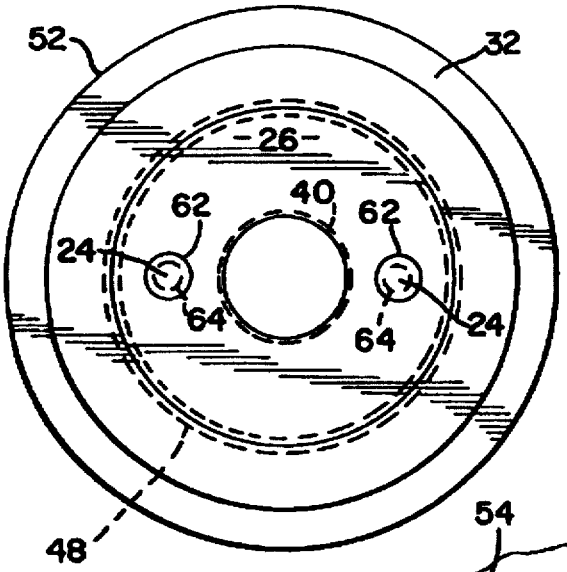
FIG. 2 is a bottom view of the gas burner of the assembly of FIG. 1.

The mounting projections 24 are located symmetrically about the collar portion 50 and are arranged to mate with the locking holes 28. Each mounting projection 24 includes a distal end with an enlarged head portion 62. The enlarged head portion 62 is generally circular in shape as viewed from the bottom (FIG. 2) and has a diameter somewhat smaller than the diameter of the entry portion 54 of the corresponding locking hole 28 so that the enlarged head portion 62 can be received through the entry portion 54.

Extending between the enlarged head portion 62 and the burner base wall 26 is a reduced diameter neck portion 64. The reduced diameter neck portion 64 has a generally circular cross section smaller than the diameter of the enlarged head portion 62 and slightly smaller than the distance between the side walls 60 of the capture portion 56 of the corresponding locking hole 28.

In accordance with the invention, the mounting projections 24 are integral and of one single piece with the burner base wall 26. The term "integral and of one single piece with" as used in this description and in the following claims means that the mounting projections and the wall are integral and continuous parts of a single generally homogeneous piece of metal. Excluded from this definition are assemblies made by permanently or temporarily attaching together separate parts such as a wall and a stud or other fastener by welding, braising, soldering, threading, adhesives or the like.

Figures 9, 10, 11, 12, 13A, 13B:
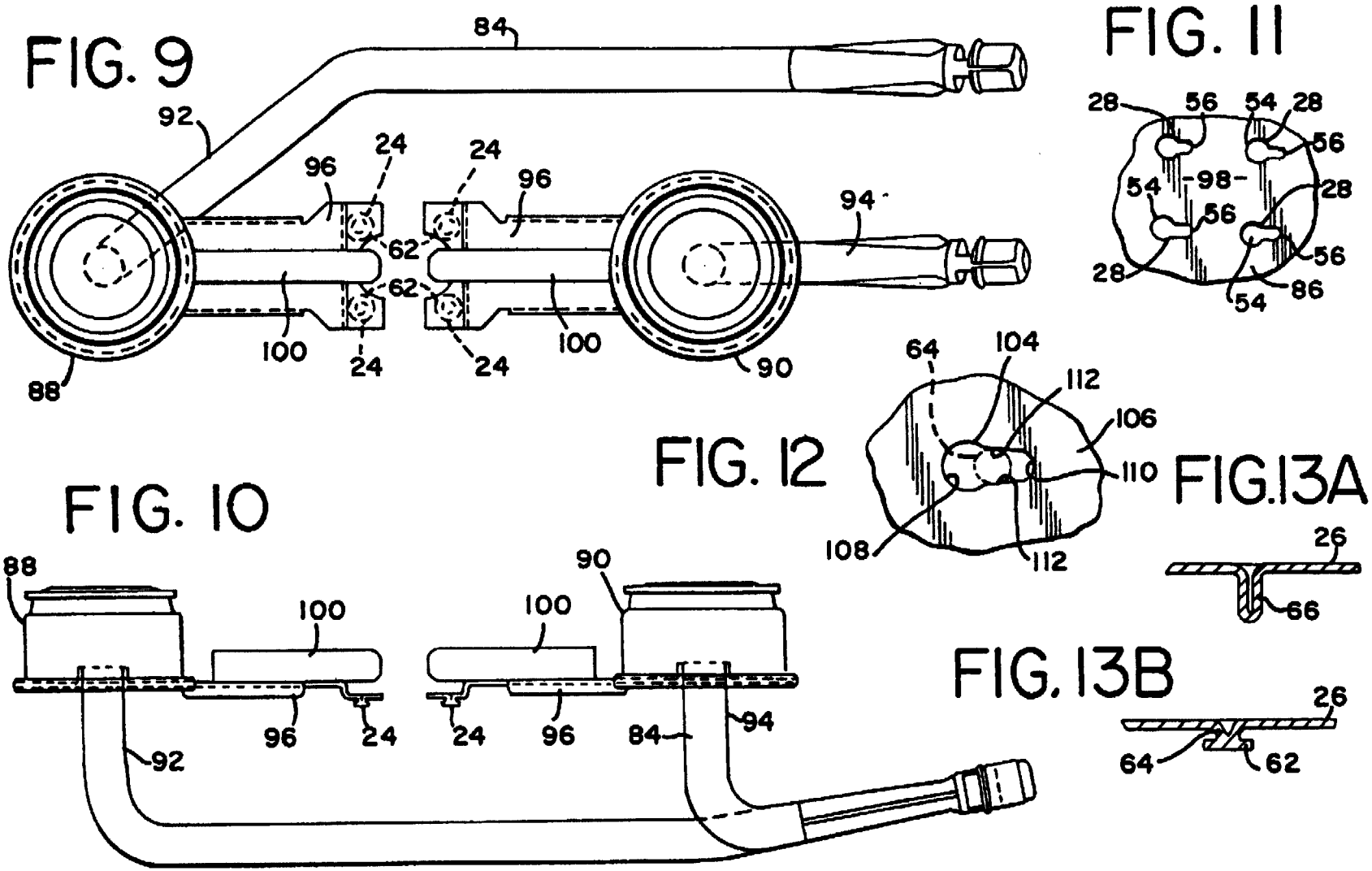
FIG. 9 is a top view of a range top burner assembly.
FIG. 10 is a side view of the assembly of FIG. 9.
FIG. 11 is a fragmentary top view of a range top wall to which the assembly of FIG. 9 is to be mounted.
FIG. 12 is a fragmentary top view of a range top wall having an alternate locking hole shape.
FIGS. 13A and 13B illustrate successive steps in a method for forming a mounting projection on a range top wall.

FIGS. 13A and 13B illustrate steps in a method for forming a mounting projection 24 integral and of one single piece with the wall 26. The wall 26 is formed of a workable material such as mild or cold rolled steel, and the illustrated method may be carried out in a stamping and forming operation using progressive die tooling and stamping equipment. The method may be integrated into the fabrication sequence in which the burner base wall 26 is made from flat sheet metal stock.

As seen in FIG. 13A, initially a protuberance 66 is formed extending downwardly from the lower surface of the wall 26. The protuberance 66 may be generally circular in cross section and may have a generally uniform cross section throughout. Alternatively the protuberance 66 may be slightly tapered and may be thickest at the junction with the wall 26.

A subsequent step in forming the mounting projection 24 is illustrated in FIG. 13B. The distal end of the protuberance 66 is flattened in order to form the enlarged head portion 62. The remaining length of the protuberance 66 adjacent the wall 26 is left undisturbed to form the reduced neck portion 64.

In order to assemble the gas burner 20 onto the range top wall 22, first the burner 20 is positioned over the range top wall 22 with the mixing tube 38 aligned with the tube receiving hole 58. Then the burner 20 is moved toward the wall 22 and the tube 38 is inserted through the hole 58. The rotational position of the burner 20 is adjusted to align the mounting projections 24 with the locking holes 28 while the base wall 26 is maintained generally parallel with the range top wall 22.

Figure 4:
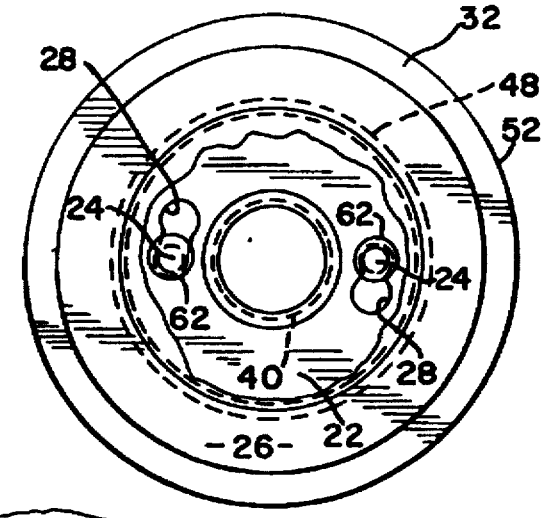
FIG. 4 is a bottom view, with part of the range top wall broken away, of the assembly of FIG. 1.

The enlarged head portions are moved into alignment with the entry portions 54 of the locking holes 28, and then the mounting projections are inserted through the locking holes 28 my moving the base wall 26 toward the wall 22. The enlarged head portions 62 pass entirely through the wall 26 and the reduced neck portions 64 move into the entry portions 54. The burner 20 is then moved in order to move the neck portions from the entry portions 54 and into the capture portions 56 of the locking holes 28 as seen in FIG. 4. In this position, because the enlarged head portions 62 are larger than the width of the capture portions 56, the burner is securely held in place by engagement of the enlarged head portions 54 against the lower surface of the range top wall 22.

The mounting arrangement of the present invention has advantages over discrete fastener systems that have been used in the past. The complexity and expense of providing and handling additional discrete parts is avoided. The mounting of the burner on the range top is accomplished easily and quickly. The burner can be removed easily and quickly for replacement or service. It is not necessary to reach beneath the range top wall to install nuts or other fasteners. No additional operations such as welding or threading of fasteners is needed. The mounting projections can be provided with essentially no incremental material cost and with very little incremental tooling and fabrication cost.

Having reference now to FIGS. 5–8 there is illustrated another gas burner mounting arrangement incorporating the principles of the present invention. In this arrangement, a mixing tube 70 is mounted to a barbeque grill gas burner 72 by engagement of a pair of mounting projections 24 with a pair of locking holes 28. The mounting projections 24 and locking holes 28 may be the same as those described in detail above in connection with the gas burner 20 and range top wall 22.

Because the gas burner 72 is used in environments where corrosion may occur, it is made of a material such as galvanized or stainless steel. Materials of this type are not well suited to the types of stamping and forming operations that result in the formation of mounting projections that are integral and of one single piece with the burner wall. Thus, in the arrangement of FIGS. 5–8, the locations of the projections and holes are reversed.

The mounting projections 24 are formed extending upwardly from a mild or cold rolled steel flange 74 of the mixing tube 70. The locking holes 28 are formed in a bottom wall 76 of the gas burner 72. The projections 24 are symmetrical about an outlet port 78 of the mixing tube 70, and the locking holes 28 are similarly symmetrical about a corresponding central inlet opening 80 of the gas burner 72.

The mixing tube 70 and the gas burner 72 are assembled in the same manner as described in detail above with respect to the gas burner 20 and the range top wall 22. The mixing tube 70 is moved do that the projections 24 are aligned with the locking holes 28. The enlarged head portions 62 pass through the entry portions 54. The mixing tube 70 is then rotated to move the neck portions 64 into the capture portions 56 of the locking holes 28. The mixing tube 70 and gas burner 72 are secured together by engagement of the enlarged head portions with the upper surface of the gas burner bottom wall 76.

Referring now to FIGS. 9–11 there is illustrated an alternative form of the present invention wherein a range top gas burner assembly 84 is mounted to a range top wall 86. In this arrangement as with those described above, the mounting securement is also accomplished by engagement of mounting projections 24 with locking holes 28. The mounting projections 24 and locking holes 28 are the same as those described above in detail in connection with the gas burner 20 and the range top wall 22.

The gas burner assembly 84 includes a pair of gas burners 88 and 90 having center entry mixing tubes 92 and 94 extending to the front of the assembly for communication with a range top gas manifold (not shown). Rather than mount the bottom walls of the burners 88 and 90 directly to the range top wall 86, mounting brackets 96 are used. A bracket 96 extends from each burner 88 and 90 to a central mounting region 98 of the range top wall 86. A source of ignition such as a spark generating device or a pilot light (not shown) is conventionally located at the central region 98, and each bracket 96 supports a flash tube 100 for communication of flame from the ignition source to the corresponding burner 88 or 90.

The mounting brackets 96 are formed of a mild or cold rolled steel. A pair of mounting projections 24 are formed integral and of one single piece with each of the mounting brackets 96. The assembly 84 thus includes four mounting projections 24. A like number of locking holes 28 (FIG. 11) are formed in the range top wall 86 in the central mounting region 98.

Because of space and clearance considerations, it is not convenient to rotate the gas burner assembly 84 in order to mount it on the range top wall 86. Consequently, the locking holes 28 are arranged so that all of the capture portions 56 of the locking holes 28 extend in the same cartesian direction. To mount the gas burner assembly, the projections 24 are aligned with the locking holes 28. The enlarged head portions 62 are inserted through the entry portions 54 of the locking holes 28. Then the gas burner assembly is moved along a straight line path, to the right as seen in FIG. 11, to move the neck portions 64 of the locking projections 24 into the capture portions 56 of the locking holes 28. The burner assembly 70 is secured in place by engagement of the enlarged head portions 62 with the lower surface of the range top wall 86.

An alternative form of locking hole 104 is illustrated in FIG. 12. The locking hole 104 is formed in a wall 106 that may be a burner bottom wall or burner mounting wall such as a range top wall. The locking hole 104 includes an entry portion 108 similar to the entry portion 54 of the locking hole 24 and sized to receive the enlarged head portion 62 of the mounting projection 24.

A capture portion 110 of the locking hole 104 extends laterally from the entry portion 108. The width of the capture portion 110 is less than the diameter of the enlarged head portion 62. Side walls 112 of the capture portion 110 are not parallel. The capture portion 110 is tapered from a relative wider width adjacent the entry portion 108 to a relatively narrower width at its opposite end. The neck portion 64 of a mounting projection 24 is shown by a broken line in FIG. 12. The result of the tapered capture portion shape is that the neck portion 64 is wedged or jammed into the capture portion 110. The frictional fit resists movement of the neck portion 64 back to the entry portion 108 and provides an additional retention function.

While the present invention has been described with reference to the details of the embodiments of the invention shown in the drawing, these details are not intended to limit the scope of the invention as claimed in the appended claims.

What is claimed is:

1. Apparatus for mounting a domestic gas cooking burner on a mounting member, said apparatus comprising:

a burner wall defined by the burner and a mounting wall defined by the mounting member;

a first of said walls being formed of cold rolled steel;

said burner and mounting walls being interfacing and adjacent to one another;

a mounting projection extending from said first wall toward and through a second of said walls;

said projection being integral and of one single piece with said first wall and including an enlarged locking head and a reduced neck between said first wall and said locking head;

said second wall including a locking hole receiving said mounting projection;

said locking hole including an entry portion larger than said locking head for passage of said locking head through said second wall; and said locking hole including a capture portion extending laterally from said entry portion, said capture portion being smaller than said locking head and large enough to receive said reduced neck.

2. Apparatus as claimed in claim 1, said first wall comprising said burner wall and said burner wall comprising a bottom wall of the gas burner.

3. Apparatus as claimed in claim 2, said second wall comprising said mounting wall, said mounting wall comprising a range top wall.

4. Apparatus as claimed in claim 1, said second wall comprising said burner wall and said burner wall comprising a bottom wall of the gas burner.

5. Apparatus as claimed in claim 4, said first wall comprising said burner wall and said burner wall comprising a mixing tube flange.

6. Apparatus as claimed in claim 1, said first wall comprising said burner wall and said burner wall comprising a mounting bracket for the gas burner.

7. Gas burner mounting apparatus as claimed in claim 1 wherein a plurality of mounting projections extend from said first wall and a like plurality of locking holes are formed in said second wall.

8. Gas burner mounting apparatus as claimed in claim 7 wherein said plurality is two.

9. Gas burner mounting apparatus as claimed in claim 8 wherein said capture portions of said locking holes extend in opposite cartesian directions.

10. Gas burner mounting apparatus as claimed in claim 7 wherein said capture portions of said locking holes extend in the same cartesian direction.

11. Gas burner mounting apparatus as claimed in claim 7 wherein said capture portions of said locking holes extend in different cartesian directions.

12. Gas burner mounting apparatus as claimed in claim 1 wherein said capture portion has parallel side walls.

13. Gas burner mounting apparatus as claimed in claim 1 wherein said capture portion has tapered side walls.

14. A method of mounting a domestic gas burner having a burner wall to a mounting member having a mounting wall, said method comprising:

making a locking hole in a first of said walls;

said making step including providing an entry portion in the first wall and a narrower capture portion in the first wall extending laterally from the entry portion;

forming a mounting projection upon a second of said walls;

said forming step including shaping a protuberance from the material of the second wall, the protuberance having a size to fit in the narrower capture portion, and then flattening the end of the protuberance to form an enlarged head portion larger than the narrower capture portion and sized to fit in the entry portion;

positioning the gas burner and mounting member so that the enlarged head portion is aligned with the entry portion;

moving the gas burner relative to the mounting member to insert the enlarged head portion through the entry portion; and shifting the gas burner relative to the mounting member to slide the protuberance into the narrower capture portion.

15. A method as claimed in claim 14, said shifting step comprising rotating the burner relative to the mounting member.

16. A method as claimed in claim 14, said shifting step comprising moving the burner in a straight line relative to the mounting member.

* * * * *